US007800305B2

(12) United States Patent
Chang et al.

(10) Patent No.: US 7,800,305 B2
(45) **Date of Patent: *Sep. 21, 2010**

(54) PLASMA DISPLAY PANEL WITH DIELECTRIC LAYER EXTENDING IN NON-DISPLAY AREA

(75) Inventors: Yi-Hyun Chang, Suwon-si (KR); Byung-Soo Jeon, Suwon-si (KR); Young-Ho Chin, Suwon-si (KR); Byung-Yoon Jeon, Suwon-si (KR)

(73) Assignee: Samsung SDI Co., Ltd., Gongse-dong, Giheung-gu, Yongin-si, Gyeonggi-do (KR)

( * ) Notice: Subject to any disclaimer, the term of this patent is extended or adjusted under 35 U.S.C. 154(b) by 254 days.

This patent is subject to a terminal disclaimer.

(21) Appl. No.: 11/976,457

(22) Filed: Oct. 24, 2007

(65) Prior Publication Data

US 2008/0054811 A1 Mar. 6, 2008

Related U.S. Application Data

(63) Continuation of application No. 10/992,376, filed on Nov. 19, 2004, now Pat. No. 7,304,432.

(30) Foreign Application Priority Data

Nov. 27, 2003 (KR) ..... 10-2003-0085114

(51) Int. Cl.
*H01J 17/49* (2006.01)

(52) U.S. Cl. ..... 313/582; 313/586; 313/587

(58) Field of Classification Search ..... 313/582–587, 313/485

See application file for complete search history.

(56) References Cited

U.S. PATENT DOCUMENTS 5,541,618 A 7/1996 Shinoda (Continued)

FOREIGN PATENT DOCUMENTS

EP 0 806 786 11/1997

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms and Discharge Characteristics; Annex C—Gaps and Annex D—Manufacturing.

*Primary Examiner*—Joseph L Williams
*Assistant Examiner*—Kevin Quarterman
(74) *Attorney, Agent, or Firm*—Robert E. Bushnell, Esq.

(57) ABSTRACT

A Plasma Display Panel (PDP) in which a dummy area is arranged so as to retain phosphor paste ejected from extra nozzles when a plurality of nozzles are used to apply phosphor paste. The PDP includes a first substrate and a second substrate opposing each other; address electrodes arranged on the first substrate; display electrodes arranged on the second substrate perpendicular to a direction of the address electrodes; barrier ribs arranged in a space between the first substrate and the second substrate to define a plurality of discharge cells; and phosphor layers arranged in each of the discharge cells; wherein a display area comprises a plurality of the discharge cells arranged at positions where the address electrodes and the display electrodes cross each other; wherein a non-display area is arranged adjacent to an edge of the display area along a direction perpendicular to a direction in which phosphor layers of the same color are applied to discharge cells neighboring each other; and wherein the phosphor layers are arranged in portions of the non-display area.

18 Claims, 4 Drawing Sheets

U.S. PATENT DOCUMENTS

| | | | | |
|---|---|---|---|---|
| 5,661,500 | A | 8/1997 | Shinoda et al. | |
| 5,663,741 | A | 9/1997 | Kanazawa | |
| 5,674,553 | A | 10/1997 | Shinoda et al. | |
| 5,724,054 | A | 3/1998 | Shinoda | |
| 5,786,794 | A | 7/1998 | Kishi et al. | |
| 5,952,782 | A | 9/1999 | Nanto et al. | |
| RE37,444 | E | 11/2001 | Kanazawa | |
| 6,630,916 | B1 | 10/2003 | Shinoda | |
| 6,707,436 | B2 | 3/2004 | Setoguchi et al. | |
| 7,030,560 | B2 | 4/2006 | Ko et al. | 313/582 |
| 7,304,432 | B2 * | 12/2007 | Chang et al. | 313/582 |
| 2004/0201351 | A1 | 10/2004 | Woo et al. | 313/582 |
| 2005/0023980 | A1 | 2/2005 | Moon | 313/ 584 |
| 2005/0077823 | A1 | 4/2005 | Song et al. | 313/582 |
| 2005/0082982 | A1 | 4/2005 | Kim | 313/587 |
| 2005/0093448 | A1 | 5/2005 | Moon et al. | 313/582 |
| 2005/0104519 | A1 | 5/2005 | Jeon | 313/582 |

FOREIGN PATENT DOCUMENTS

| | | |
|---|---|---|
| JP | 2845183 | 10/1998 |
| JP | 2917279 | 4/1999 |
| JP | 2000-306512 | 11/2000 |
| JP | 2001-035381 | 2/2001 |
| JP | 2001-043804 | 2/2001 |
| JP | 2001-325888 | 11/2001 |
| KR | 100-2001-0051849 | 6/2001 |

* cited by examiner

PLASMA DISPLAY PANEL WITH DIELECTRIC LAYER EXTENDING IN NON-DISPLAY AREA

CROSS-REFERENCE TO RELATED APPLICATIONS

This application is filed as a Continuation of Applicants' patent application Ser. No. 10/992,376 filed in the U.S. Patent & Trademark Office on the 19$^{th}$ of Nov. 2004 now U.S. Pat. No. 7,304,432, and assigned to the assignee of the present invention. All benefits accruing under 35 U.S.C. §120 from the parent application are also hereby claimed.

CLAIM OF PRIORITY

This application makes reference to, incorporates the same herein, and claims all benefits accruing under 35 U.S.C. §119 from an application entitled PLASMA DISPLAY PANEL WHICH IS SUITABLE FOR SPREADING PHOSPHORS filed with the Korean Intellectual Property Office on 27 Nov. 2003, and there duly assigned Serial No. 10-2003-0085114.

BACKGROUND OF THE INVENTION

1. Field of the Invention

The present invention relates to a Plasma Display Panel (PDP), and more particularly, to dummy areas of a PDP which enable retention of phosphor paste ejected from extra nozzles when a plurality of nozzles are used to apply the phosphor paste.

2. Description of the Related Art

A Plasma Display Panel (referred to hereinafter simply as a "PDP") displays images based on a plasma discharge. When voltages are supplied to electrodes arranged in discharge cells of the PDP, a plasma discharge occurs between the electrodes to generate ultraviolet rays. The ultraviolet rays excite phosphor layers arranged in a predetermined pattern, thereby displaying the desired images.

This PDP is fabricated by first forming a plurality of barrier ribs and then forming phosphor layers thereon. Presently, photolithography, screen-printing, and the like are used to form phosphor layers.

However, when panels have high definition or closed barrier ribs, there are many problems in using a screen printing method or the like due to a narrow pitch of the discharge cells. Also, although inkjet methods and photolithography methods have been developed and used, these methods may be not suitable for mass production of PDPs due to the complex production processes required.

SUMMARY OF THE INVENTION

It is therefore an object of the present invention to provide an improved design for a PDP.

It is also an object of the present invention to provide a PDP that enables optimization of a process for applying phosphor paste, and to achieve mass production of PDPs using a nozzle jet method.

These and other objects can be achieved by a PDP in which a dummy area is arranged so as to retain phosphor paste ejected from extra nozzles when a plurality of nozzles are used to apply the phosphor paste.

A PDP according to one embodiment of the present invention comprises: a first substrate and a second substrate opposing each other; address electrodes arranged on the first substrate; display electrodes arranged on the second substrate perpendicular to a direction of the address electrodes; barrier ribs arranged in a space between the first substrate and the second substrate to define a plurality of discharge cells; and phosphor layers arranged in each of the discharge cells; wherein a display area comprises a plurality of the discharge cells arranged at positions where the address electrodes and the display electrodes cross each other; wherein a non-display area is arranged adjacent to an edge of the display area along a direction perpendicular to a direction in which phosphor layers of the same color are applied to discharge cells neighboring each other; and wherein the phosphor layers are arranged in portions of the non-display area.

The non-display area preferably comprises a plurality of non-discharge cells respectively corresponding to no more than two electrodes.

A mean depth of phosphor layers arranged in the display area is preferably substantially the same as a mean depth of phosphor layers arranged in the non-display area.

The phosphor layers are preferably arranged on the non-discharge cells of the non-display area adjacent to the discharge cells of the display area.

The phosphor layers are preferably formed by a nozzle jet apparatus having a plurality of nozzles.

Non-display areas are preferably respectively arranged at two ends of the display area such that the display area is interposed between the non-display areas.

The barrier ribs arranged in the display area are also preferably continuously arranged on one of the first and second substrates corresponding to the non-display area.

The non-display area preferably has a width of from 600 μm to 10,000 μm perpendicular to the direction in which phosphor layers of the same color are applied to discharge cells neighboring each other.

A PDP according to another embodiment of the present invention comprises: a first substrate and a second substrate opposing each other; a plurality of discharge cells arranged between first and second substrates; and phosphor layers arranged in each of the discharge cells; wherein a display area comprises a plurality of the discharge cells arranged at predetermined positions; wherein a non-display area is arranged adjacent to an edge of the display area along a direction perpendicular to a direction in which phosphor layers of the same color are applied to discharge cells neighboring each other; and wherein the phosphor layers are arranged in portions of the non-display area.

The non-display area preferably comprises a plurality of non-discharge cells.

A mean depth of phosphor layers arranged in the display area is preferably substantially the same as a mean depth of phosphor layers arranged in the non-display area.

The phosphor layers are preferably arranged on the non-discharge cells of the non-display area adjacent to the discharge cells of the display area.

The phosphor layers are preferably formed by a nozzle jet apparatus having a plurality of nozzles.

Non-display areas are preferably respectively arranged at two ends of the display area such that the display area is interposed between the non-display areas.

The PDP preferably further comprises barrier ribs arranged in the display area and also continuously arranged in the non-display area.

The non-display area preferably has a width of from 600 μm to 10,000 μm perpendicular to the direction in which phosphor layers of the same color are applied to discharge cells neighboring each other.

BRIEF DESCRIPTION OF THE DRAWINGS

A more complete appreciation of the present invention, and many of the attendant advantages thereof, will be readily apparent as the present invention becomes better understood by reference to the following detailed description when considered in conjunction with the accompanying drawings, in which like reference symbols indicate the same or similar components, wherein.

DETAILED DESCRIPTION OF THE INVENTION

Figure 1:
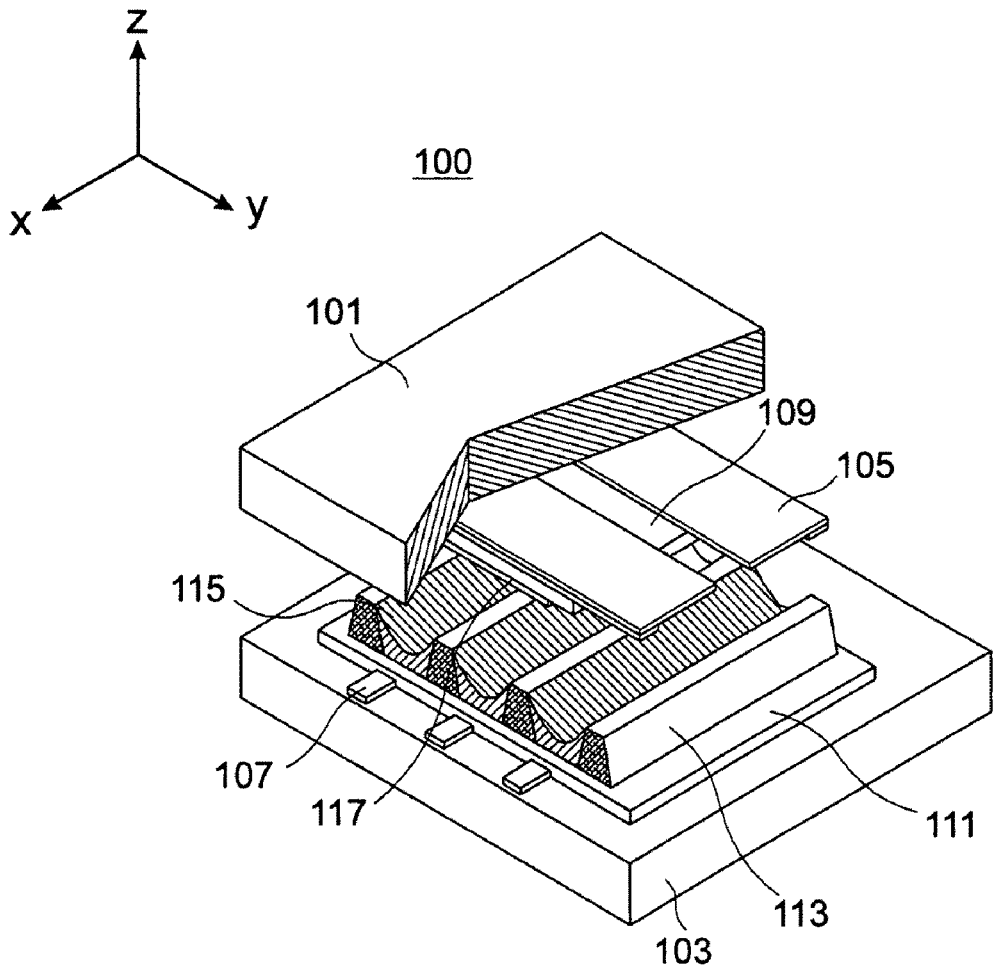
FIG. 1 is an exploded perspective view of a PDP.

Different types of PDPs include AC-PDPs, DC-PDPs, and hybrid PDPs. FIG. 1 is a partial exploded perspective view of an AC-PDP with a matrix barrier rib configuration.

With reference to FIG. 1, an AC-PDP 100 includes a rear substrate 103, address electrodes 107 formed on the rear substrate 103, a dielectric layer 111 formed on an entire surface of the rear substrate 103 to cover the address electrodes 103, a plurality of barrier ribs 113 formed over the dielectric layer 111 with a constant distance therebetween to prevent the occurrence of cross-talk among the cells, and phosphor layers 115 formed between each of the neighboring barrier ribs 113. A plurality of display electrodes 105 are formed on the front substrate 101, arranged in pairs and spaced from each other at a distance corresponding to one discharge cell and intersecting the address electrodes 107 formed on the rear substrate 103. A dielectric layer 109 and a protective layer 117 are formed sequentially to cover the display electrodes 105. An inert gas such as a Ne, Xe, or the like is injected into the above-structured discharge cells.

With the above-structured PDP, when a high voltage is supplied to the display electrodes 105, vacuum ultraviolet rays are generated by the inert gas, which excite the phosphors of the phosphors layer 115 to realize images.

Figure 2:
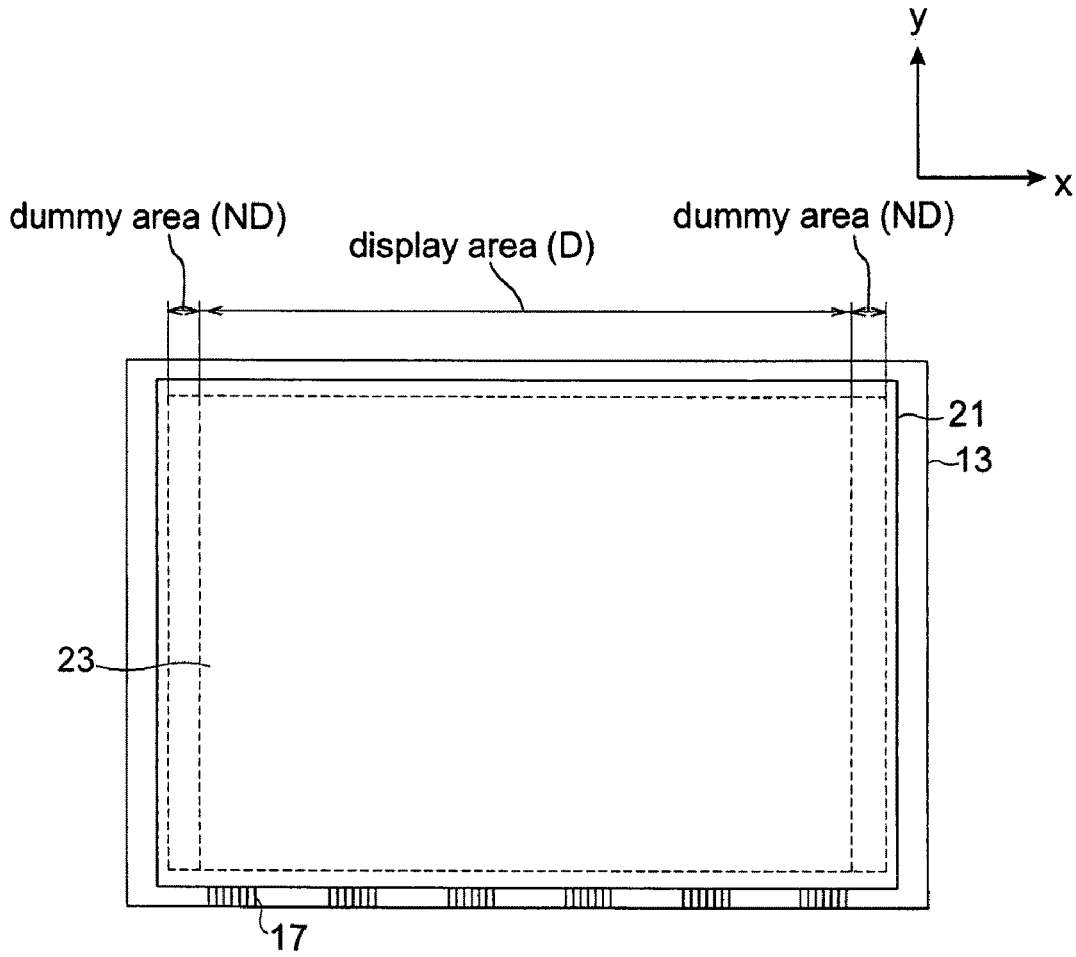
FIG. 2 is a plane view of a rear plate of a PDP according to an embodiment of the present invention.

FIG. 2 is a plane view of a rear plate of a PDP according to an exemplary embodiment of the present invention.

In this embodiment, a plurality of address electrodes 17 are formed (along the Y direction of FIG. 2) on a substrate 13, and a dielectric layer 21 and a plurality of barrier ribs 23 are subsequently formed thereon. Then, red, green, and blue phosphor paste (not shown) is applied between the neighboring barrier ribs and fired.

While not shown in FIG. 2, a plurality of display electrodes are formed along the direction perpendicular to the direction of the address electrodes 17 on another substrate, and a dielectric layer and a MgO protective layer are formed sequentially to cover the display electrodes. Thereafter, frit is applied along the edge of the both substrates and is fired to join the substrates hermetically. Finally, an inert gas such as Ne or Xe or the like is injected into the above-structured vacuum vessel to complete the PDP according to an embodiment of the present invention.

With the above-structured PDP, a high voltage is supplied to the display electrodes (not shown) and the address electrodes to generate an address discharge therebetween and to accumulate wall charges on the dielectric layer (not shown). Vacuum ultraviolet rays are generated by the plasma phase of the inert gas, which excite the phosphors of the phosphor layer to realize images.

Figure 3:
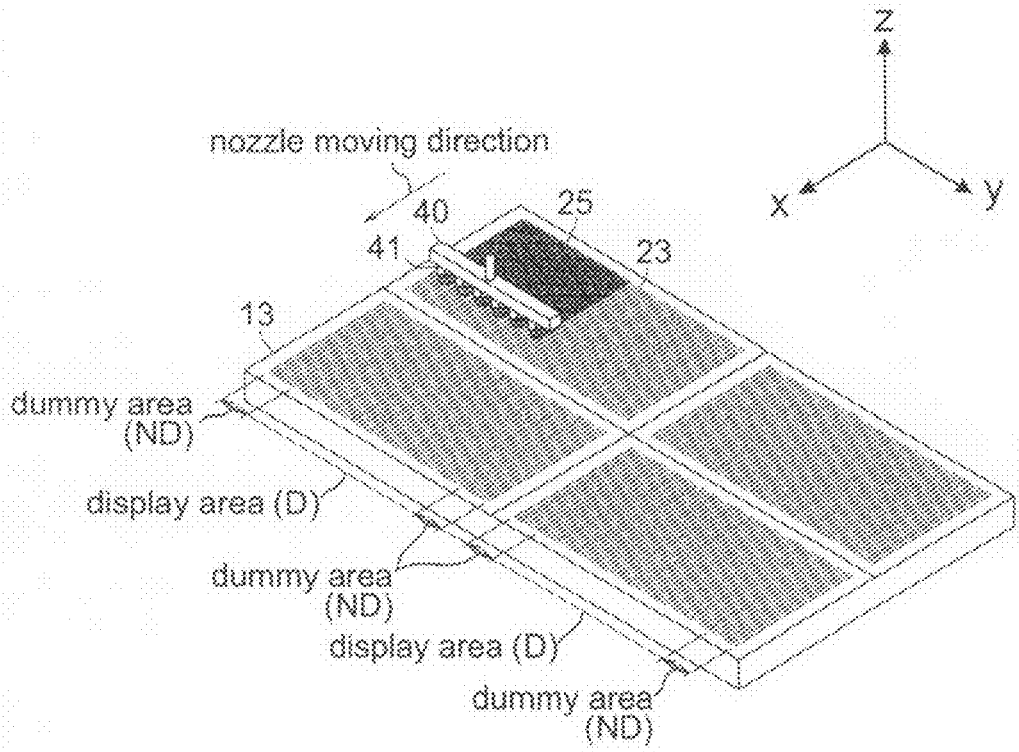
FIG. 3 is a schematic view of a process of forming many faces in order to manufacture a plurality of PDPs according to an embodiment of the present invention.

As shown in FIG. 2 and FIG. 3, in the PDP according to an embodiment of the present invention, address electrodes 17 cross the display electrodes to form image pixels, and these image pixels are aggregated to form a display area D. A non-display area ND is formed adjacent to the display area D between and outside each of the display areas D.

Since the non-display areas are only used to the protect barrier ribs from collapsing or the like on forming the barrier ribs, they are unrelated to the plasma discharge. Accordingly, the non-display areas are indicated as dummy areas. The dummy areas ND have either address electrodes or display electrodes that do not generate a plasma discharge.

As shown in FIG. 2, although dummy areas ND are formed on both sides of the display area D along the direction of the address electrodes 17, the dummy areas can also be formed at either side of the display area D, where the process for applying phosphor paste begins.

FIG. 3 is a schematic view of a process of forming many faces in order to manufacture a plurality of PDPs according to an embodiment of the present invention.

As shown in FIG. 3, four PDPs are arranged on one glass baseplate. However, the the number of PDPs is not limited thereto.

With reference to FIG. 3, a nozzle jet apparatus 40 has a plurality of nozzles 41, and it moves along the direction in which barrier ribs 23 of the PDP are formed while forming phosphor layers 25 between the barrier ribs 23. In this embodiment, although dummy areas ND are formed on one or more sides of the display area D or on both sides of the display area D along the direction phosphor layers of the same color are formed as shown in FIG. 3, the phosphor layers 25 need not be formed over the entire dummy areas ND. The phosphor layers 25 are fired to bond them after arranging them in the discharge cells.

When a nozzle jet apparatus having a plurality of nozzles 41 is used to apply a phosphor paste, it is not economical for a nozzle jet apparatus to be manufactured with the same number of nozzles as the total number of barrier ribs. Also, when the number of nozzles is different from the total number of the barrier ribs, the nozzle jet apparatus becomes complex in that some of the nozzles may be open while others are closed.

Therefore, it is preferable that a nozzle jet apparatus with a predetermined number of nozzles passes in and out of dummy areas ND formed on both sides of the display area D to form the phosphor layers. With the above-structured dummy areas, the phosphor layers 25 that are fired and bonded after being formed in the discharge cells have fewer floating particles, thereby reducing the possibility of mis-discharges or the like occurring.

Particularly, to manufacture a purality of PDPs on one mother substrate, as described above, it is preferable that the dielectric layer and barrier ribs are continuously simultaneously formed along the direction of the address electrodes. Accordingly, the dielectric layer and barrier ribs for a plurality of PDPs formed on one glass baseplate can be formed while being continuously connected. The dielectric layers and barrier ribs can be formed approximately to the end of one substrate along the direction that the phosphor layers of the same color are formed. These ends can be formed at one end or at both ends of the substrate according to the number of PDPs formed on one glass baseplate.

Such a dummy area may have a width of from 600 μm to 10,000 μm perpendicular to the direction in which phosphor layers of the same color are applied to discharge cells neighboring each other. If the width of the dummy area is below 600 μm, then the dummy area is too narrow to have a sufficient area for uniformly applying the phosphor paste. Also, considering the width of the display area and one substrate, it is impossible for the dummy area to have a width above 10,000 μm.

Figure 4:
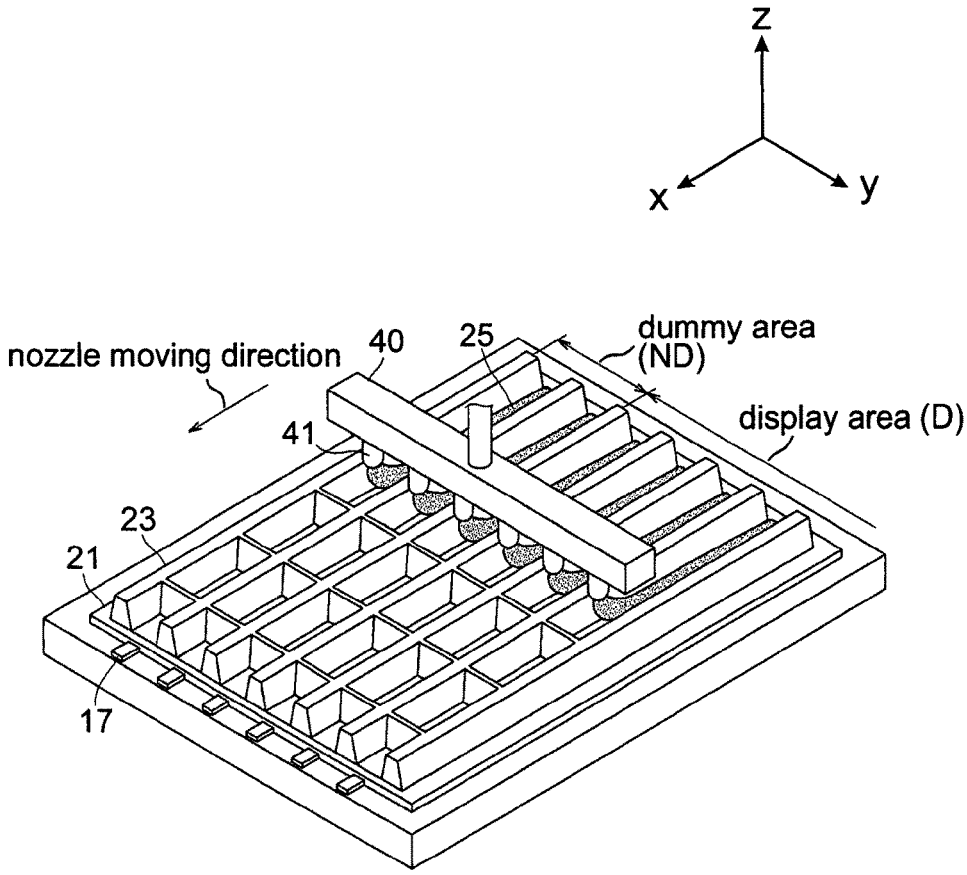
FIG. 4 is a perspective view of a process of applying phosphor paste in a PDP according to an embodiment of the present invention.

FIG. 4 is a perspective view of a process of applying a phosphor paste in the PDP according to an embodiment of the present invention.

With reference to FIG. 4, in the PDP according to an embodiment of the present invention, the display area D and the dummy area ND are formed in parallel and are neighboring each other along the direction of the address electrodes. In this embodiment, a nozzle jet apparatus 40 has a plurality of nozzles 41, and it moves along the direction in which barrier ribs 23 of the PDP are formed while forming phosphor layers 25 between the barrier ribs 23. The phosphor layers 25 can be formed over the portion of such dummy areas ND according to the number of nozzles 41 matched with the barrier ribs. Therefore, the phosphor layers 25 can be formed only on the portion of the dummy area adjacent to the display area D.

When the phosphor layers 25 are formed by such a nozzle jet method, the depth of the phosphor layers can be approximately the same at the dummy area ND and the display area D due to the same forming conditions of the phosphor layers between these two areas.

As described above, according to the embodiment of the present invention, when the phosphor paste is fired after being applied, the phosphor particle adhered to the barrier ribs to reduce the number of floating particles and thereby reduce the possibility of mis-discharges or the like occurring.

Also, the present invention can enable optimization of a process of applying a phosphor paste and achieving mass production of PDPs using a nozzle jet method in which the total number of nozzles is the same as the number of barrier ribs, by a nozzle jet apparatus going and coming several times while using the extra dummy areas.

Finally, since the dummy areas can be positioned on both sides of the display area, the phosphor paste can be selectively applied to the dummy areas, and a process of applying the phosphor paste can be flexibly achieved.

Although embodiments of the present invention have been described in detail hereinabove in connection with certain exemplary embodiments, it should be understood that the present invention is not limited to the disclosed exemplary embodiments, but, on the contrary is intended to cover various modifications and/or equivalent arrangements included within the spirit and scope of the present invention, as defined by the appended claims.

What is claimed is:

1. A Plasma Display Panel (PDP), comprising:

a first substrate and a second substrate opposing each other;

address electrodes arranged on the first substrate;

display electrodes arranged on the second substrate perpendicular to a direction of the address electrodes;

a dielectric layer arranged on the first substrate to cover the address electrodes;

barrier ribs arranged in a space between the first substrate and the second substrate to define a plurality of discharge cells; and a phosphor layer arranged in each of the discharge cells;

wherein a display area includes the plurality of discharge cells arranged at positions where the address electrodes and the display electrodes cross each other, and wherein a plasma discharge occurs in the display area;

wherein a non-display area is arranged adjacent to an edge of the display area along a direction parallel to a direction in which phosphor layers of the same color are applied to discharge cells neighboring each other, and wherein the plasma discharge does not occur in the non-display area; and wherein the dielectric layer extends beyond an edge of the non-display area; and wherein the phosphor layer is arranged in portions of the non-display area.

2. The PDP of claim 1, wherein the non-display area comprises a plurality of non-discharge cells respectively corresponding to no more than two electrodes.

3. The PDP of claim 1, wherein a mean depth of phosphor layers arranged in the display area is equal to a mean depth of phosphor layers arranged in the non-display area.

4. The PDP of claim 1, wherein the phosphor layer is arranged on the non-discharge cells of the non-display area adjacent to the discharge cells of the display area.

5. The PDP of claim 1, wherein each phosphor layer is formed by a nozzle jet apparatus having a plurality of nozzles.

6. The PDP of claim 1, wherein the non-display areas are respectively arranged at two ends of the display area such that the display area is interposed between the non-display areas.

7. The PDP of claim 1, wherein the barrier ribs arranged in the display area are also continuously arranged on one of the first and second substrates corresponding to the non-display area.

8. The PDP of claim 1, wherein the non-display area has a width in a range of 600 μm to 10,000 μm perpendicular to the direction in which phosphor layers of the same color are applied to discharge cells neighboring each other.

9. The PDP of claim 1, wherein the non-display area comprises a plurality of non-discharge cells having a same pattern as the discharge cells of the display area.

10. A Plasma Display Panel (PDP), comprising:

a first substrate and a second substrate opposing each other;

a plurality of discharge cells arranged between the first substrate and the second substrate; and a dielectric layer arranged on the first substrate;

a phosphor layer arranged in each of the discharge cells;

wherein a display area includes the plurality of discharge cells arranged at predetermined positions, and wherein a plasma discharge occurs in the display area;

wherein a non-display area is arranged adjacent to an edge of the display area along a direction parallel to a direction in which phosphor layers of the same color are applied to discharge cells neighboring each other, and wherein the plasma discharge does not occur in the non-display area; and wherein the dielectric layer extends beyond an edge of the non-display area; and wherein the phosphor layer is arranged in portions of the non-display area.

11. The PDP of claim 10, wherein the non-display area comprises a plurality of non-discharge cells arranged where the plasma discharge does not occur.

12. The PDP of claim 11, wherein the non-discharge cells of the non-display area have a same pattern as the discharge cells of the display area.

13. The PDP of claim 10, wherein a mean depth of phosphor layers arranged in the display area is equal to a mean depth of phosphor layers arranged in the non-display area.

14. The PDP of claim 10, wherein the phosphor layer is arranged on the non-discharge cells of the non-display area adjacent to the discharge cells of the display area.

15. The PDP of claim 10, wherein each phosphor layer is formed by a nozzle jet apparatus having a plurality of nozzles.

16. The PDP of claim 10, wherein the non-display areas are respectively arranged at two ends of the display area such that the display area is interposed between the non-display areas.

17. The PDP of claim 10, further comprising barrier ribs arranged in the display area and also continuously arranged in the non-display area.

18. The PDP of claim 10, wherein the non-display area has a width in a range of 600 μm to 10,000 μm perpendicular to the direction in which phosphor layers of the same color are applied to discharge cells neighboring each other.

* * * * *